US006277793B1

(12) United States Patent
Popelar

(10) Patent No.: US 6,277,793 B1
(45) Date of Patent: Aug. 21, 2001

(54) LIQUID CLARIFIER ADDITIVE FOR MACHINE TOOL COOLANTS

(75) Inventor: Frank J. Popelar, Britton, MI (US)

(73) Assignee: Popelar Filter Co., Inc., Tecumseh, MI (US)

( * ) Notice: Subject to any disclaimer, the term of this patent is extended or adjusted under 35 U.S.C. 154(b) by 0 days.

(21) Appl. No.: 09/489,358

(22) Filed: Jan. 21, 2000

Related U.S. Application Data

(60) Provisional application No. 60/116,833, filed on Jan. 22, 1999.

(51) Int. Cl.[7] ..... C10M 141/02
(52) U.S. Cl. ..... 508/160
(58) Field of Search ..... 508/160

(56) References Cited

U.S. PATENT DOCUMENTS 2,393,863 * 1/1946 Myers .
2,564,926 * 8/1951 Rapier .
3,026,888 * 3/1962 Gorand .
3,819,521 * 6/1974 Sims .
4,448,701 * 5/1984 Duerksen et al. .

* cited by examiner

*Primary Examiner*—Jerry D. Johnson
(74) *Attorney, Agent, or Firm*—James M. Deimen

(57) ABSTRACT

An additive for machine tool coolants, generally water-based coolants, to eliminate static electricity, foam and inhibit rust, causes contaminants to settle-out in the coolant and thereby be more easily removed from the coolant return tank bottoms. The composition of the additive comprises glycerin, propylene glycol, Butyl Cellosolve®, Igepal CO-43O™ and borax in suitable proportions.

12 Claims, No Drawings

LIQUID CLARIFIER ADDITIVE FOR MACHINE TOOL COOLANTS

This application is based on provisional patent application No. 60/116,833 filed Jan. 22, 1999.

BACKGROUND.

The present invention is directed to an additive for machine tool coolant and more particularly to a clarifier additive for controlling static electricity in machine tool coolants.

Additives for liquid coolants and static electric compositions are known in the art. Various types of equipment for either adding additives or, for example, detecting static electricity are also known in the art. The following is a list of prior art patents which are directed to this subject matter.

U.S. Pat. No. 2,393,863
U.S. Pat. No. 2,564,926
U.S. Pat. No. 2,909,190
U.S. Pat. No. 2,928,406
U.S. Pat. No. 3,026,888
U.S. Pat. No. 3,164,747
U.S. Pat. No. 3,399,133
U.S. Pat. No. 3,405,722
U.S. Pat. No. 3,449,668

Machine tool coolants are well known in the art and are used, for example, in abrasive grinders, drilling machines and milling machines to cool and lubricate the cutting tools or cutting wheels as the work pieces are being drilled, ground or milled. The coolants are normally recycled. Various contaminants are found in the recycled water-based coolants.

SUMMARY OF THE INVENTION.

The present invention is an additive which is added to the coolant, generally water-based coolant, to eliminate static electricity. This helps contaminants, regardless of their size, to settle to the bottom. It has been found that the additive also acts as a mild nist inhibitor and as an anti- foaming agent.

DESCRIPTION OF THE PREFERRED EMBODIMENT.

A preferred additive composition, according to the present invention, in weight percent is indicated below.

| Preferred Composition | % (by weight) |
|---|---|
| Glycerin | 25.2 |
| Propylene Glycol | 29.1 |
| Butyl Cellosolve ® | 9.0 |
| Igepal CO-430 ™* | 4.2 |
| Borax | 32.5 |
| | 100.0 |

*The Igepal CO-430 ™ (nonylphenoxypoly ethyleneoxy ethanol) (nonoxynol) nonionic surfactant is mixed with 10% Butyl Cellosolve ® (ethylene glycol monobutyl ether).

It has been found that Butyl Cellosolve® acts as a coupler.

Preferably, the borax is first dissolved in the glycerin. The propylene glycol is then added and mixed. The mixture of surfactant and coupler, specifically Igepal CO-430™ compound and the Butyl Cellosolve®, is mixed together and then added to the borax, glycerin and propylene glycol mix.

The liquid clarifier additive, according to the present invention, is normally added to a water-based coolant at a rate of 0.5%, or one part of additive to 200 parts of water-based coolant, by volume.

In some situations, this rate is increased to as high as 1%, or one part of additive per 100 parts of water-based coolant, by volume.

Two samples of the liquid clarifier additive, according to the present invention, were tested to determine certain physical properties. The results were as follows:

| | Sample 1 | Sample 2 |
|---|---|---|
| Specific Gravity (20° C.) | 1.126 | 1.122 |
| pH (1% Solution) | 8.8 | 8.8 |
| Viscosity (SUS 100° F.) | 251 sec. | 227 sec. |
| Flash Point (Closed Cup) | 250° F. | 220° F. |
| Color | Clear | Clear Green |
| Odor | Bland | Bland |

It has been found that the liquid clarifier additive, according to the present invention, keeps an abrasive wheel cleaner longer, thereby creating a better finish on the workpiece. It also tends to keep the workpiece less out of round in a grinding operation, while at the same time sinking aluminum chips, carbon-cast iron chips and other contaminants to the bottom of the return portion of the liquid coolant tank or reservoir. The contaminants, including the workpiece chips, can then be more easily removed, for example, with a drag line conveyor.

It has been found that this often results in a 10% to 50% savings of expenses resulting from savings in down time, labor, abrasives, coolants, hazardous water removals and even diamond costs.

If the liquid clarifier additive is used, for example, in steel mills, where acid is used to treat the steel, the contaminants are urged to the bottom while, for example, the oil used to lubricate the bearings tends to move to the surface where such oil can be removed.

It has been found that a liquid clarifier additive, according to the present invention, provides a superior method and product for controlling static electricity over the prior art.

What is claimed is:

1. A machine tool coolant liquid clarifier additive comprising glycerin, propylene glycol, ethylene glycol monobutyl ether, nonoxynol and borax.

2. The machine tool coolant liquid clarifier additive of claim 1 wherein the weight percentage of each constituent is glycerin 25.2%, propylene glycol 29.1%, ethylene glycol monobutyl ether 9.0%, nonoxynol 4.2% and borax 32.5%, the ethylene glycol monobutyl ether percentage not including any ethylene glycol monobutyl ether incorporated in the nonylphenoxypoly (ethyleneoxy) ethanol percentage.

3. The machine tool coolant liquid clarifier additive of claim 2 wherein the nonoxynol is nonylphenoxypoly (ethyleneoxy) ethanol.

4. A machine tool coolant wherein the liquid clarifier additive of claim 3 comprises 0.5% by volume of the machine tool coolant.

5. A machine tool coolant according to claim 4 comprising a water-based coolant.

6. A machine tool coolant wherein the liquid clarifier additive of claim 1 comprises a minimum percentage of 0.5% by volume and as much as 1% by volume of the machine tool coolant.

7. A machine tool coolant according to claim 6 comprising a water-based coolant.

8. The method of controlling static electricity in a machine tool coolant comprising the addition of a liquid clarifier additive according to claim 1 to the machine tool coolant.

9. The method of claim 8 wherein the machine tool coolant is water-based.

10. The method of abrading a metallic workpiece comprising flowing a machine tool coolant according to claim 6 over the abrading means and workpiece.

11. A method of preparing a liquid clarifier additive comprising the steps of:

dissolving borax in glycerin, mixing propylene glycol with the borax-glycerin solution, mixing nonoxynol with ethylene glycol monobutyl ether, and adding the nonoxynol and ethylene glycol monobutyl ether mix to the borax, glycerin and propylene glycol mix.

12. The method of claim 11 wherein the nonoxynol is nonylphenoxypoly (ethyleneoxy) ethanol.

* * * * *